United States Patent [19]

Wirtgen

[11] Patent Number: 4,826,352

[45] Date of Patent: May 2, 1989

[54] MACHINE FOR CUTTING OFF OR PLANING OFF ROAD SURFACES

[76] Inventor: Reinhard Wirtgen, Hohner Strasse 2, 5469 Windhagen, Fed. Rep. of Germany

[21] Appl. No.: 128,876

[22] Filed: Dec. 3, 1987

[30] Foreign Application Priority Data

Dec. 15, 1986 [DE] Fed. Rep. of Germany ..... 3642809

[51] Int. Cl.[4] ..... E01C 23/12

[52] U.S. Cl. ..... 404/90; 404/104; 299/39

[58] Field of Search ..... 404/90, 91, 96, 104; 299/36–40, 73, 75

[56] References Cited

U.S. PATENT DOCUMENTS

| | | | |
|---|---|---|---|
| 1,830,751 | 11/1931 | Cornett | 299/37 |
| 3,778,110 | 12/1973 | Staab | 299/39 |
| 4,175,886 | 11/1979 | Moench et al. | 404/90 |
| 4,262,966 | 4/1981 | Bouplon | 299/37 X |
| 4,714,295 | 12/1987 | Wirtgen | 404/90 X |

FOREIGN PATENT DOCUMENTS

| | | | |
|---|---|---|---|
| 2420330 | 11/1975 | Fed. Rep. of Germany | 404/90 |
| 2540047 | 3/1977 | Fed. Rep. of Germany | 299/39 |
| 2556547 | 6/1977 | Fed. Rep. of Germany | 404/104 |
| 3013569 | 10/1981 | Fed. Rep. of Germany | 404/90 |
| 3200862 | 7/1983 | Fed. Rep. of Germany | 404/90 |
| 2155525 | 9/1985 | United Kingdom | 299/39 |

*Primary Examiner*—Jerome W. Massie, III
*Assistant Examiner*—John F. Letchford
*Attorney, Agent, or Firm*—W. Thad Adams, III

[57] ABSTRACT

In a machine for cutting off or planing off road surfaces, having a steerable chassis with an independent drive motor, and a planing or cutting tool which is located within the contour base line of the chassis and is fixed in vertically adjustable manner on the chassis, a further planing or cutting tool of smaller dimensions is provided which is located outside the contour lines of the chassis. The further planing or cutting tool sits on a bracket which is arranged laterally in translatory moveable manner on the chassis so that the further planing or cutting tool on the bracket can be positioned in a dead space in front of, behind or above the chassis, which dead space is located within the contour lines of the chassis. The further planing or cutting tool permits the cutting of special profiles at the edge of the roadway but, on account of its capacity to be moved, does not restrict the useability of the cutting machine in traffic.

5 Claims, 3 Drawing Sheets

MACHINE FOR CUTTING OFF OR PLANING OFF ROAD SURFACES

FIELD OF THE INVENTION

The invention relates to a machine for cutting off or planing off road surfaces, having a steerable chassis with an independent drive motor, and a planing or cutting tool which is located within the contour base line of the chassis and is fixed in a vertically adjustable manner on the chassis.

PRIOR ART

In known machines of this generic type, frequently located between the steerable front wheel pair and the rear wheels as a cutting tool is a cutting roller which is fitted with a plurality of cutters. During operation, this cutting roller is located in a lowered position and rotates in the opposite direction to the direction of travel. When the machine is moved from one place of use to another, the cutting roller or the planing tool is moved into a raised position so that the machine can be moved in traffic like a truck. In these machines, the planing or cutting tool extends over virtually the entire width of the chassis.

Moreover, machines are known which are equipped with a relatively narrow planing or cutting tool. These machines are used for deep or profile cutting, it being possible, depending on the construction of the tool, for profiles of different width and shape to be produced. These machines are generally substantially smaller than the machines described above and are therefore frequently moved by trucks from one place of use to another, which of course is more laborious and expensive than moving the machine itself.

SUMMARY OF THE INVENTION

It is therefore the object of the invention to improve the known large machines for cutting off or planing off road surfaces to the extent that smaller cutting and planing work and in particular deep or profile cutting work can also be carried out with these machines.

This object is achieved according to the invention when a further planing or cutting tool is available which is located outside the contour lines of the chassis, and when the further planing or cutting tool sits on a bracket which is arranged laterally in translatory moveable manner on the chassis in such a way that the further planing or cutting tool on the bracket can be positioned in a dead space in front of, behind or above the chassis, which dead space is located within the contour line of the chassis.

The invention is based on the consideration, obvious per se, to equip a large machine for cutting off or planing off road surfaces with an additional cutting or planing tool so that the planing or cutting work which is the preserve of such a tool can thus also be carried out with the large machine. Since this work, which is the preserve of the small cutting tool, is carried out almost exclusively in the edge area of the roadway, it is absolutely essential to arrange this tool in the lateral area of the large machine. However this results in the problem that the permissible overall width of the large machine is exceeded and the machine may only be driven from one place of use to another with the special permission of the police. The advantages resulting with the integration of the tool for smaller cutting or planing work, which advantages include simpler transport of the planing or cutting tool, lower investment costs, since a second chassis with a drive motor and the other peripheral equipment necessary for the tool are no longer required, but rather equipment on the large machine can be put to double use, and a more favorable range of applications, would thereby be brought to nothing. In a further development of the inventive idea, however, this is prevented by the special arrangement of the planing or cutting tool, which arrangement permits the cutting or planing tool to be shifted at the side of the chassis from the working position into a transporting position in which the cutting or planing tool no longer gets in the way during transport from one place of use to another. This transporting position can be in front of the nose of the vehicle or behind its tail, or else also above the vehicle and if necessary its superstructural parts if the large machine has already reached its overall length permissible for traffic.

In a preferred embodiment, the bracket supporting the further planing or cutting tool is mounted on a slide rail which is fixed laterally on the chassis and has a part which projects beyond the nose or the tail of the chassis and can be pivoted into the dead space in front of or behind the chassis. The further planing or cutting tool is displaced from its working position on the bracket, which working position lies between the front wheels and the rear wheels, into the nose or tail area via the slide rail, and in fact beyond the nose tip or the tail end. The rail end projecting beyond the nose or the tail, together with the further planing or cutting tool sitting on this rail end, is swung in front of the nose or behind the tail. The tool can be additionally locked in this position so that, when the large machine is traveling from one place of use to anther, unintentional pivoting of the swung-in slide rail piece with the tool located on it is prevented.

The end of the slide rail remote from the nose or the tail most expediently ends in the area of the planing or cutting tool located within the contour base line of the chassis. Thus the further planing or cutting tool is located in the direct proximity of the main planing or cutting tool so that optimum planing or cutting results can be achieved.

The most varied designs can be used for the construction of the slide rail. It has proved to be advantageous to provide the slide rail with at least one triangular longitudinal profile which interacts with two or more prismatic rollers mounted on the bracket. In this way, an especially good easy-running quality can be achieved so that the tool can also be displaced manually from the working position into the transporting position and vice versa.

In an especially advantageous embodiment, the slide rail is provided with two triangular longitudinal profiles which are parallel to one another at a distance, and the bracket is provided with several prismatic rollers which accommodate the slide rail between them and of which the prismatic rollers allocated to a longitudinal profile are adjustable. The advantage of such an embodiment is in particular that on the one hand the bearing clearance can be accurately set by the adjustment of the prismatic rollers, and on the other hand the bracket can also be inclined at a certain angle to the vertical when the prismatic angles of the longitudinal profile and roller are different so that special profiles can be cut or planed. The latter can be achieved by the adjustable prismatic rollers expediently being adjustable in a longitudinally axial manner. To set the clearance, it is advisable to make the adjustable prismatic rollers adjustable in the radial direction toward the longitudinal profile.

In an expedient embodiment, the further planing or cutting tool is arranged in a vertically adjustable manner on the bracket. A vertical adjustability up to about 300 mm has proved to be adequate for all cutting or planing work which occurs. In a cutting tool in the form of a cutting roller, the vertical adjustability can be realized in advantageous manner when the cutting roller is mounted on a pivot arm which is articulated on the bracket and on which a positioning cylinder acts which is articulated on the bracket. By actuation of the positioning cylinder, the pivot arm can be pivoted and thus the cutting roller can be adjusted in its height or cutting depth.

It has proved to be expedient to provide the cutting roller with an independent drive motor. The drive could actually also be effected by a motor arranged on the chassis for other purposes, but separation of the drive line is then necessary when moving the cutting roller from its working position into its transporting position, and, moreover, a special drive mechanism is necessary which is able to compensate the change in height between the cutting roller and the drive motor.

A cable winch is most expediently provided for displacing the bracket from a working position into a transporting position and back again. Actually, a positioning cylinder can also be provided for moving the bracket, but the use of a cable winch permits a simpler construction.

In another advantageous embodiment, the bracket is mounted in a sliding manner on a guide tube which is fixed laterally on the chassis, is essentially oriented vertically and the upper end of which projects in such a way beyond the upper contour line of the chassis provided with superstructural parts that the bracket, in this end area of the guide tube, can be pivoted about the longitudinal axis of the guide tube into the dead space above the chassis. This embodiment has the advantage that it can be realized at a lower cost than the embodiment described above insofar as the displacement and the vertical adjustment of the bracket and thus the further planing or cutting tool can be effected with a single drive system. Of certain disadvantage in this embodiment is that the bracket with the further planing or cutting tool, in its transporting position, represents a certain visual impairment for the vehicle driver.

A positioning cylinder is most expediently available for displacing the bracket along the guide tube. With this positioning cylinder, not only can the bracket be displaced along the guide tube, but, as already mentioned, the furthur planing and cutting tool can also be vertically adjusted, it being possible for the vertical adjustment to be made particularly accurately.

In order to protect the mounting of the bracket on the chassis from excessive vibrations and shocks during cutting or planing, it is advisable to provide means for positionally securing the bracket in its working position. In particular, centering pins and strong bolts are suitable for this purpose, but clamping cylinders are also suitable, and this is particularly advantageous on account of the simple manipulation.

So that profiles can also be cut and planed which do not come within the scope of normal practice, it has proved to be expedient to fix the further planing or cutting tool on the bracket in such a way that it can be pivoted about an axis parallel to the longitudinal axis of the chassis. If such a type of fixing is provided, the longitudinally axial adjustability described further above of the prismatic rollers can be dispensed with.

BRIEF DESCRIPTION OF THE DRAWINGS

The invention is described in greater detail with reference to the drawing which contains two exemplary embodiments, partly in schematic representation, and in which.

DESCRIPTION OF THE PREFERRED EMBODIMENTS

Figure 1:
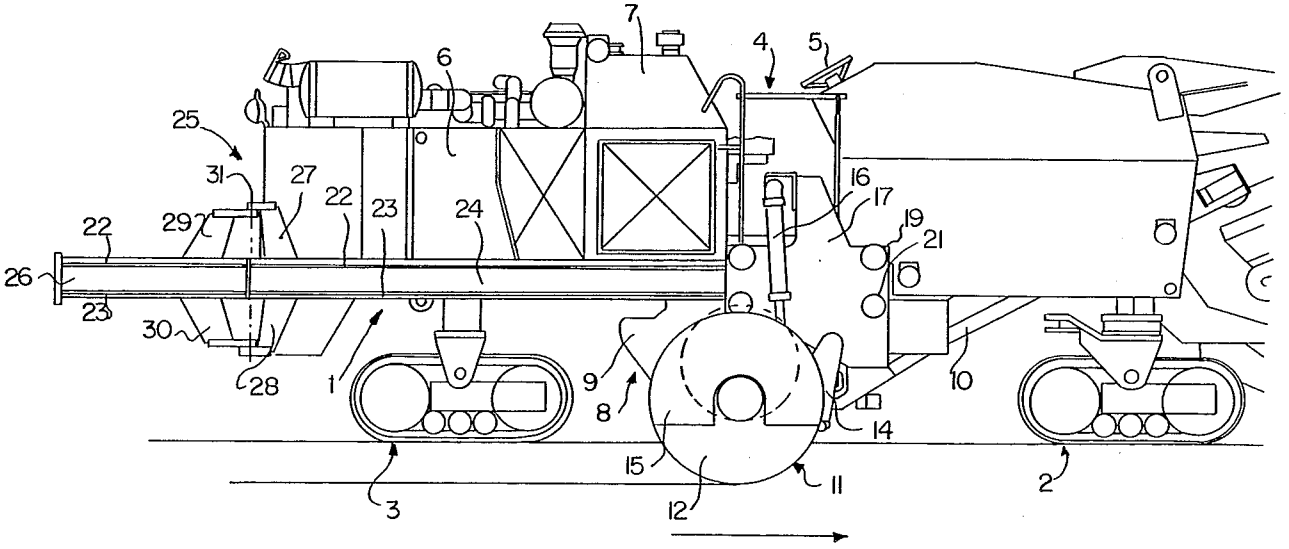
FIG. 1 shows a side view of a part of a machine for cutting off road surfaces.

The machine for cutting off road surfaces consists of a chassis 1 with a front chain-drive pair 2 and a rear chain-drive pair 3. Located on the chassis is a driver's stand 4 with a steering wheel 5 and an engine 7 for driving the rear chain-drive pair 3. Moreover, a fuel tank 7 and other equipment are arranged there which are of no importance for the description of the present invention. Located between the front chain-drive pair 2 and the rear chain-drive pair 3 is the main cutting device 8, of which only one supporting cheek 9 and also a conveying device 10 for removing the cut-off material to the front are visible. The main cutting device 8 is mounted for vertical adjustment on chassis 1 between a lower cutting position and a raised storage position.

Arranged in the area of the main cutting device 8 is a further cutting tool 11 which consists of a narrow cutting roller 12 which is arranged with its motor 13 on a pivot arm 14. The cutting roller 12 is covered by a hood 15.

A positioning cylinder 16 which is articulated at one end on a bracket 17 and at the other end on the unit consisting of the cutting roller 12 and the motor 13 is used for the vertical adjustment of the cutting roller 12.

The bracket 17 has four prismatic rollers 18, 19, 20 and 21 which are rotatably mounted on the bracket and of which the prismatic rollers 18 and 19 are allocated to a first triangular longitudinal profile 22 and the prismatic rollers 20 and 21 are allocated to a second triangular longitudinal profile 23. The two triangular longitudinal profiles 22 and 23 run parallel to and at a distance from one another and together form a slide rail 24.

The slide rail 24 extends from the area of the main cutting device 8 to the tail 25 of the chassis 1, where it continues in a part 26. In the area of the tail 25, the slide rail 24 is provided with two retaining arms 27 and 28, to which retaining arms 29 and 30 are allocated which are fixed on the slide rail piece 26. The retaining arms 27 and 28 form with the retaining arms 29 and 30 an articulation which permits the pivoting of the slide rail piece 26 about the axis 31 in the dead space behind the tail 25.

The slide rail 24 is fixed directly on the chassis 1 of the cutting machine, whereas the slide rail piece 26 is connected to the slide rail 24 merely via the above mentioned retaining arms but is otherwise freely pivotable.

Figure 3:
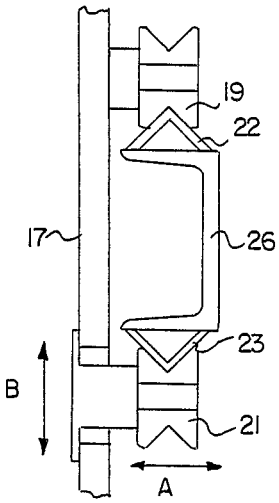
FIG. 3 shows an enlarged representation of the detail view according to FIG. 2.

As can be seen in particular from FIG. 3, by axial adjustment of the prismatic rollers 20 and 21, the bracket 17 can be moved into an inclined position relative to the slide rail 24 or the slide rail piece 26 so that special cutting profiles can also be made with the further cutting device. The bearing clearance can be set by radial adjustment of the prismatic rollers 20 and 21 in the arrow direction B shown.

Figure 2:
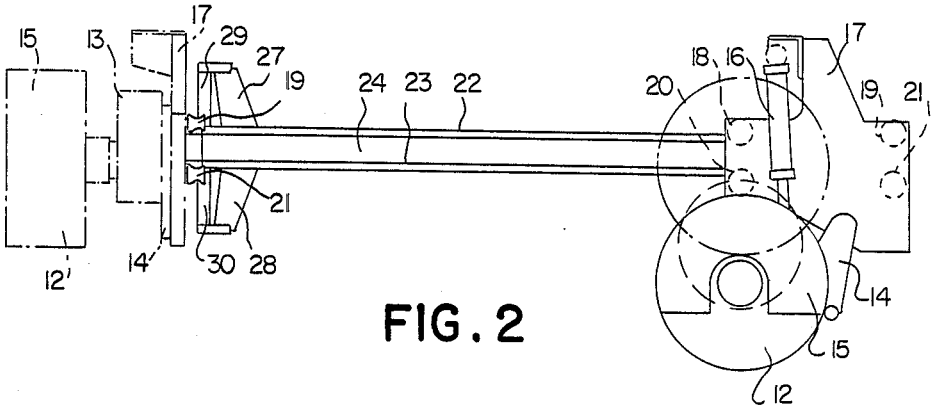
FIG. 2 shows a detail of the machine according to FIG. 1 relating to the bracket supporting the further cutting tool and the displacement of the bracket.

The further cutting device 11 is displaced from the working position shown into the transporting position shown by a broken line in FIG. 2 in such a way that first the cutting roller 12 is moved into a raised position by actuating the positioning cylinder 16 and then the securing pins which have firmly connected bracket 17 to the chassis during the cutting operation are removed. The bracket 17, together with the further cutting device 11, is then pulled along the slide rail 24 toward the tail of the machine by means of a cable line (not shown). If the bracket 17 is fully located on the slide rail piece 26, the slide rail piece 26 is pivoted about the axis 31 towards the dead space behind the tail 25 of the vehicle. This position is shown by broken lines in FIG. 2. The slide rail piece 26 with the bracket 17 is now locked and secured on the tail of the vehicle. Conversely, when the further cutting device 11 is to be shifted from its transporting position into its working position, the locking means are released again, the slide rail piece 26 is moved into the position shown in FIG. 1 and the bracket 17 with the further cutting device 11 can be moved over the slide rail piece 26 and the slide rail 24 into its working position shown in FIG. 1.

Figure 4:
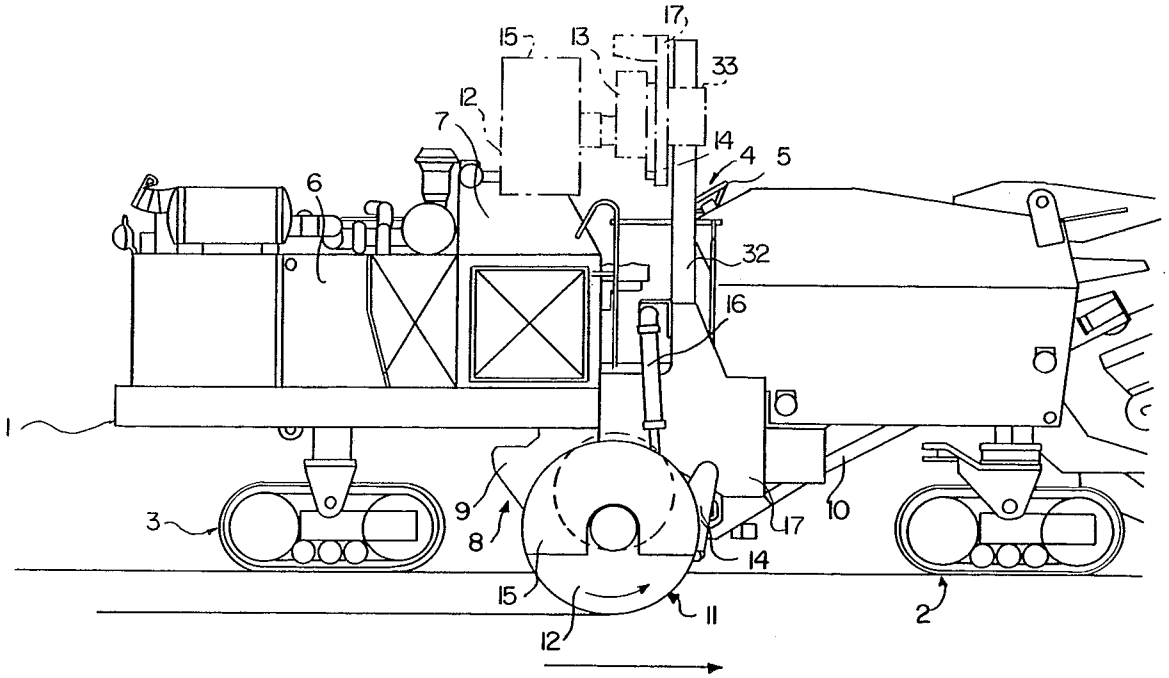
FIG. 4 shows a side view of a machine for cutting off road surfaces having a vertically displaceable bracket.

In the cutting machine according to FIG. 4, which is basically of the same construction as the machine described above, the further cutting device 11 is moved in the vertical direction out of its working position into its transporting position. For this purpose, the bracket 17 is mounted in a sliding manner by means of a sleeve 33 on a guide tube 32 fixed laterally on the chassis 1 and orientated vertically. If it is desired to shift the further cutting device 11 from its working position shown into the transporting position shown by broken lines, the bracket 17 is pulled upward along the guide tube 32 via a cable-line (not shown), and then the bracket 17, with the further cutting device 11 located upon it, is pivoted through 90 degrees into the position shown by broken lines and locked in this position. Since the cutting depth in the case of this device can be set by appropriately moving the bracket 17, the cutting roller 12 with the motor 13 can be fixed directly on the bracket 17; therefore the pivot arm 14 and the positioning cylinder 16 can be dispensed with unless importance is attached to a particularly sensitive, accurate setting of the cutting depth.

I claim:

1. In a machine for planing off or cutting off road surfaces, said machine having a steerable chassis with an independent drive motor and a first planing or cutting tool located on the chassis and mounted for vertical adjustment on the chassis, the combination therewith of a second planing or cutting tool mounted on a bracket located in a working position outside the periphery of the chassis and a guide tube carried by the chassis on which said bracket is slidably mounted, said guide tube having an upper end projecting above the chassis and said bracket being mounted on said guide tube for downward movement of the second planing or cutting tool into operating position on the road surface and for upward movement of said second planing or cutting tool into an inoperative position within and above the periphery of the chassis for storage.

2. The machine as claimed in claim 1, wherein means are provided for positionally securing the bracket in the working position of the planing or cutting tool.

3. The machine as claimed in claim 1, wherein a hydraulic cylinder is provided for positionally securing the bracket in the working position of the planing or cutting tool.

4. The machine as claimed in claim 1, 2 or 3 wherein said second planing or cutting tool is mounted for vertical movement on the bracket.

5. The machine as claimed in claim 4, wherein said planing or cutting tool comprises a cutting roller, said cutting roller being mounted on a pivot arm carried by said bracket, and a positioning cylinder mounted on said bracket for moving the bracket and the cutting roller mounted thereon into and out of operating position on the road surface.

* * * * *